US006471096B1

(12) United States Patent
Dave

(10) Patent No.: US 6,471,096 B1
(45) Date of Patent: Oct. 29, 2002

(54) METHOD AND APPARATUS FOR MAGNETICALLY MEDIATED CONTROLLED POWDER DISCHARGE

(76) Inventor: Rajesh N. Dave, 101 Mandon Dr., Wayne, NJ (US) 07470

( * ) Notice: Subject to any disclaimer, the term of this patent is extended or adjusted under 35 U.S.C. 154(b) by 0 days.

(21) Appl. No.: 09/406,545

(22) Filed: Sep. 27, 1999

(51) Int. Cl.[7] ..... B65D 83/00
(52) U.S. Cl. ..... 222/200; 222/196
(58) Field of Search ..... 222/196, 200; 366/273; 33/227, 228, 832, 512

(56) References Cited

U.S. PATENT DOCUMENTS 3,439,899 A * 4/1969 Hershler ..... 366/273
4,630,755 A * 12/1986 Campbell ..... 222/196
4,720,025 A * 1/1988 Tatevosian et al. ..... 366/273
5,052,112 A * 10/1991 MacDonald ..... 33/263

* cited by examiner

*Primary Examiner*—Joseph A. Kaufman
*Assistant Examiner*—Christopher S. Kim
(74) *Attorney, Agent, or Firm*—Benjamin Appelbaum

(57) ABSTRACT

A process and apparatus for promoting controlled flow of solid material generally comprises a container for holding the solid material and a number of magnetically hard permanent magnet particles within the solid material near the container outlet. The particles are excited with sufficient oscillating electromagnetic energy to create motion and cause sufficient disturbance to break the structure of the solid material and push it out of the outlet.

5 Claims, 5 Drawing Sheets

METHOD AND APPARATUS FOR MAGNETICALLY MEDIATED CONTROLLED POWDER DISCHARGE

FIELD OF INVENTION

In general, this invention relates to a method and an apparatus for producing a controlled powder flow or discharge of powder and/or granular materials from a bulk storage facility. More specifically, the invention pertains to the use of hard permanent magnetic media materials subjected to an oscillating magnetic field to initiate and promote a controlled flow of non-magnetic powder material out of a storage facility, hopper, bin, or a feeder.

BACKGROUND—THE INVENTION

In most industrial applications requiring the handling and/or processing of granular materials or powders, these materials often need to be stored in containers such as hoppers, bins or silos, both before and after processing. There are many problems associated with the storage and discharge of these materials from the containers. In particular, there are serious problems with the discharge, which may be based on gravity flow or other means. These may include no flow condition, which usually occurs due to bridging, arching or ratholing. Factors such as humidity, bulk weight, powder size, powder cohesiveness, and heat may adversely affect the flow conditions. Arching can occur due to mechanical interlocking, or more frequently due to the cohesive strength of the solid. Ratholing generally occurs due to high friction between the hopper walls and the material and/or due to cohesion of the material under consolidation. In some cases, the theory of geometric hopper design of Jenike may be used to overcome no flow conditions. However, the minimum outlet dimension requirement imposed by the Jenike procedure is often unrealizable for the small batch sizes in high-value added applications. Moreover, these applications require devices that produce predictable and controllable amount of flows, and avoid segregation upon delivery. Therefore active discharge aids are required.

There are three categories of these devices: pneumatic, vibrational, and mechanical. In pneumatic methods, one can use aeration, air-blasts, or air-inflators. In aeration, a controlled amount of air is introduced in the bulk, at either a high-level or low-level of aeration. An example of this is Airsweep™ by Myrlen, Inc., Boynton Beach, Fla., where powerful mini-pulses of air are directed between the material and the container wall to sweep and lift material off loping surfaces to promote flow. Another example is an air flow based Fluidizer, manufactured by Solimar Pneumatics, Minneapolis, Minn. In high-level aeration, the amount of air is sufficient to reduce wall friction and to make the material near the outlet aerated to flow like a liquid. The problem with this approach is that it may cause flooding.

In low-level aeration, the amount of air introduced is low, but enough to encounter de-aeration due to time consolidation. This prevents the flooding problem, but it cannot improve the situation where even the freshly introduced material has difficulty flowing out of the hopper. In air-blasting methods, for example, BIG BLASTER® Air Cannons manufactured by Martin Engineering, Neponset, Ill., a small quantity of high-pressure air is injected into the bulk in sudden bursts. This may impart shocks, which could break an arch or a rathole. There are potential disadvantages such as damage to the walls or the structure, and flooding.

Other pneumatic devices utilize inflatable pads mounted along the hopper walls, which are activated at regular time intervals. For highly cohesive materials, this technique can cause further problems due to increased compaction. In vibrational techniques, either the vibrations are applied to the hopper wall, or mounted vibrating devices agitate the entire powder bulk near the outlet, as in Geiser et al., U.S. Pat No. 5,472,117. Wall mounted vibrators may fail to transmit the vibrations where needed, and in some cases, further compact the material.

In methods such as Geiser et al. and others called bin-activators (manufactured for example by Vibra Screw Inc., Totowa, N.J.), a substantially impermeable pre-shaped member such as a plate or an inverted cone is supported inside the powder container, near its outlet. It is then coupled to a vibrator unit and upon the activation of vibrations, flow may occur. A disadvantage of this device is the need for providing and supporting the said member. Another disadvantage is that the diameter of the said member is preferred to be greater than or equal to the minimum arching or coring diameter of the powder material. This preference makes this device useless for small batch applications. Other potential disadvantage is the creation of noise when the device is operated.

In mechanical methods, an arm or a screw moves inside the bulk and it continuously acts against a stable formation of an arch or a rat-hole. For highly cohesive materials, excessive stresses are generated on the mechanical arm, making it susceptible to damage and high power needs. Overall, many of these methods may be effective for certain situations, for many cases hey do not work properly and even cause additional problems. These problems include uncontrollable flow, flooding, dust explosion, damage to hopper walls, segregation upon discharge, increased powder compaction, etc.

None of the prior art to actively promote powder flow out of a container such as a bin or a hopper is based on the use of small, dispersed media such as hard permanent magnetic particles. The prior art generally deals with excitations transmitted by one or a few large sources such as a vibrated member, compressed air unit(s), inflatable pads, or moving members. None are based on the idea of utilizing tens of thousands of individual excitation sources, such as individually propelled magnetic particles. Such magnetic media has been used in other applications listed in the following. In Kuznetsov et al., U.S. Pat. No. 3,987,967, magnetic elements of a magnetically hard material is placed in a chamber along with other material being worked upon. The action of an alternating magnetic field produced by an electric winding causes chaotic motion of the magnetic material and causes grinding of the powder material. In Hoffa, U.S. Pat. No. 4,090,263, one large magnetic element is rotated by the action of an externally positioned rotating magnetic bar to mix the sample materials such as biological fluids. Watanabe et al., in U.S. Pat. No. 4,632,316, describe a method and apparatus for electromagnetically processing substances by crushing, mixing and stirring the substances, including an apparatus equipped with a container for receiving ferromagnetic or non-magnetic conductive working pieces, together with substances to be processed by causing a shifting magnetic field to act on a generate a strong random motion of the working pieces. The emphasis, in contrast to Kuznetsov et al. is on properly changing the electromagnetic field intensity level. Abrosimov et al., in U.S. Pat. No. 4,995,730, disclose a method of electromagnetic working of materials wherein a stream of material to be worked is continuously fed into a working zone which accommodates a layer of magnetic elements, wherein a variable magnetic field is generated to actuate the layer of chaotically moving magnetic elements to work the material being fed. The material to be worked on can be a fluid, suspension or emulsion. The invention is to be used for dispersing, emulsifying and mixing suspensions, predominantly in the chemical and related industries. Abrosimov et al. invention is claimed to be an improvement of prior art (U.S. Pat. Nos. 3,219,318, 3,987,967) by improving the power efficiency of the process. Another improvement is described in Halbedel et al., U.S. Pat. No. 5,348,237, where an apparatus for reducing, dispersing, wetting and mixing pumpable, nonmagnetic, multiphase mixtures by means of magnetic media propelled by electromagnetic energy is described. This technique is limited to fluid based mixtures.

It is important to distinguish that the magnetic media is utilized in the prior art generally for working, dispersing, emulsifying, crushing, grinding, mixing, or coating the material of fluid, fluid-particle or particulate nature. None of the prior art is concerned with promoting a controlled amount of powder discharge out of a storage container using such magnetic media.

Related to the topic of powder flow from hoppers is the concept of an angle of repose (AOR) of the powder material. In general, this is the angle formed when a powder material is poured into a heap or a pile. In many powder and bulk material applications, one often needs to measure the AOR, because it is one of the indicators of the flowability of the material. There are several different ways to measure the angle of repose. In a tilt table method, the material for which the AOR is to be measured is placed evenly on a horizontal table or a platform. Then, the inclination of the table is gradually and slowly increased till the material just starts to flow. The angle at which this occurs is measured and is denoted as the AOR of that material. In another approach, the material for which the AOR is to be measured is poured to form a heap. The heap could be either of a fixed height or of a fixed base. The angle of that heap is then measured and is denoted as the AOR of that material. The pouring may be facilitated by use of one or more funnels or chutes. Another method utilizes a rotating cylinder in which the powder or bulk material for which the AOR is to be measured is placed. The sealed cylinder is then placed on a rotation station, such that its axis of revolution is also the axis of rotation. The speed of rotation is adjusted till more or less uniform, steady state slope of the powder or bulk material has formed. The angle of that slope is then measured and is denoted as the AOR of that material. There are other techniques such as in Soviet Union Patent No. 1,758,408, where AC (alternating current) at given frequency is passed to a solenoid of a vibro-drive, which applies vertical oscillating movement to a tank containing material to be tested. Some of the material falls through a hole in the bottom into a vessel. A conical concave surface is formed in the tank and a convex cone is formed in the vessel, whose angles correspond to the collapse and repose angles of the bulk material. The limitation of these methods in prior art is that it is difficult to get accurate, repeatable results for highly cohesive powders using these techniques. Moreover, none of the prior art utilizes magnetic particles as the media that creates controlled flow of the material to form a heap.

It is a general objective of the present invention to promote a flow of stored powder material from a bulk storage in a controlled fashion.

It is a related objective to provide a means to produce a metered discharge of powders at rates as low as a few grams or fractions of a gram per second.

It is an associated objective to provide a powder discharge technique that is particularly suited for small batch applications, involving about 1000 or 2000 Kg amounts.

It is a more detailed objective to provide a means to create evenly dispersed excitation within the powder bulk, generated by hundreds or thousands of individual sources such as the magnetic media.

It is an associated objective to minimize the segregation of the powder material upon discharge due to the chaotic nature of excitation of the powder.

It is a related objective to minimize adverse effects of powder excitation such as powder compaction or powder flooding.

It is another objective to minimize the need for internal support structures and large movable parts in the process of powder excitation.

It is yet another objective to have a device that minimizes the damage to the container due to powder excitation.

It is a related objective to reduce the level of noise associated with powder excitation.

It is an associated objective to have a device that produces stable, clean piles or heaps of powder and thus allow for accurate determination of angle of repose of the powder material.

It is an additional objective to have a simple device that minimizes the operator error during determination of angle of repose of the powder, and minimizes the occurrence of false peaks.

SUMMARY OF THE INVENTION

These and other objects of the invention which shall be hereafter apparent are achieved by a method for magnetically mediated controlled powder discharge which provides a means to promote a controlled flow of powder or dry bulk material out of a storage container such as a silo, bin or a hopper by the motion of magnetically hard permanent particles acting as the media within the powder near the storage outlet. The magnetic particles are excited by a sufficient electromagnetic energy supplied from an oscillating magnetic field. A screen or a mesh is placed near the outlet so as to prevent said magnetic particles from leaving the storage through outlet. Alternately, an additional, strong magnetic field that counteracts gravity is provided to keep said magnetic particles suspended within the container and thus are prevented from leaving the storage through outlet. Said additional magnetic field is placed in a suitable location and is suitably turned on and off to facilitate levitation of the magnetic particles. Action of individually excited magnetic particles create evenly dispersed excitation within the powder to promote an even flow and controlled discharge out of hopper.

BRIEF DESCRIPTION OF THE DRAWINGS

The invention will be better understood by the Detailed Description of the Preferred Embodiments with reference

DETAILED DESCRIPTION OF THE PREFERRED EMBODIMENTS

While the present invention will be described in connection with a set of preferred embodiments, it will be understood that it is not intended to limit the invention to those embodiments. On the contrary, it is intended to cover all alternatives, modifications and equivalents as may be included within the spirit and scope of the invention.

Figure 1:
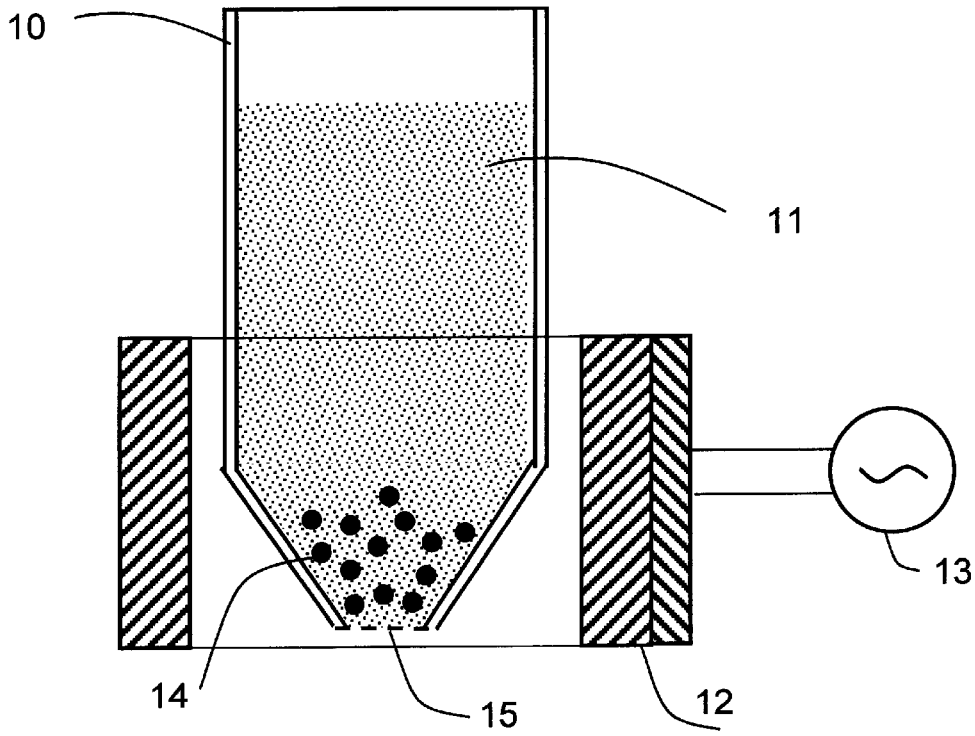
FIG. 1 is a cross-sectional view of a flow discharge system of the present invention.

An example of a preferred embodiment is shown in FIG. 1, where a storage container 10 is intended to contain a powder material 11, which needs to be discharged from the bottom opening of container 10. Container 10 can be a bin, silo or hopper and can be of a variety of shapes and sizes, with shapes ranging in cross-section from cylindrical to rectangular, and may have sloping walls of conical or wedge type shape. It can have a wide range of volume capacities, starting from 1 cc and up. It contains powder material 11 that can be also any other bulk solid material of a variety of types, shapes and sizes. Container 10 can be constructed of a number of different materials, but preferably of non-magnetic variety, in particular near the outlet region, so that a magnetic field induced by a magnetic field coil 12 driven by alternating current power supply 13 may reach within the space of container 10. Magnetically hard permanent magnet particles 14 are placed near the outlet of container 10, and could be dispersed within powder material 11. Upon power supply, magnetic field generated by the magnetic field generator 12, such as a field coil, excite magnetic particles 14, causing them to spin and violently move and initiate powder 11 to flow through outlet of container 10 covered by a screen 15. Screen 15 can be any type of mesh that can retain magnets 14 while allowing powder 11 to pass through. It must be sufficiently strong to withstand flow of powder 11 and collisions by magnets 14. There could be additional parts and mechanisms to facilitate the removal or delivery of the powder material when it comes out through the screen 15.

Figure 2:
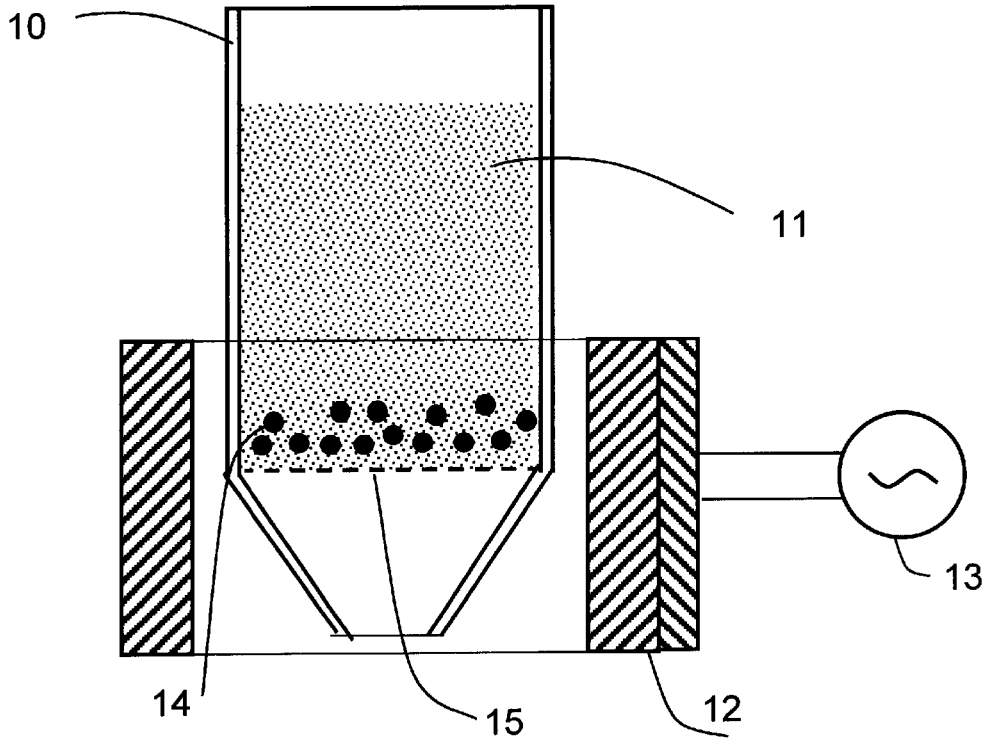
FIG. 2 is a cross-sectional view of another preferred embodiment of the present invention, showing an alternate position of retaining screen.

Another example of a preferred embodiment is shown in FIG. 2, which describes an alternate placement of screen 15. All arrangements of elements 10, 11, 12, 13, and 14 are the same as in the previous description. However, as shown, screen 15 is in a different location. Screen 15 is placed at a higher location for distributing magnetic particle excitement all across the bottom portion of powder material 11. Such placement is preferred in certain applications. Preferred embodiments shown in FIG. 1 and FIG. 2 are intended to illustrate various possible configurations of screen 15 with respect to tapered part of storage 10, and indicate that these and other intermediate placements of screen 15 are within the scope of present invention.

Figure 3:
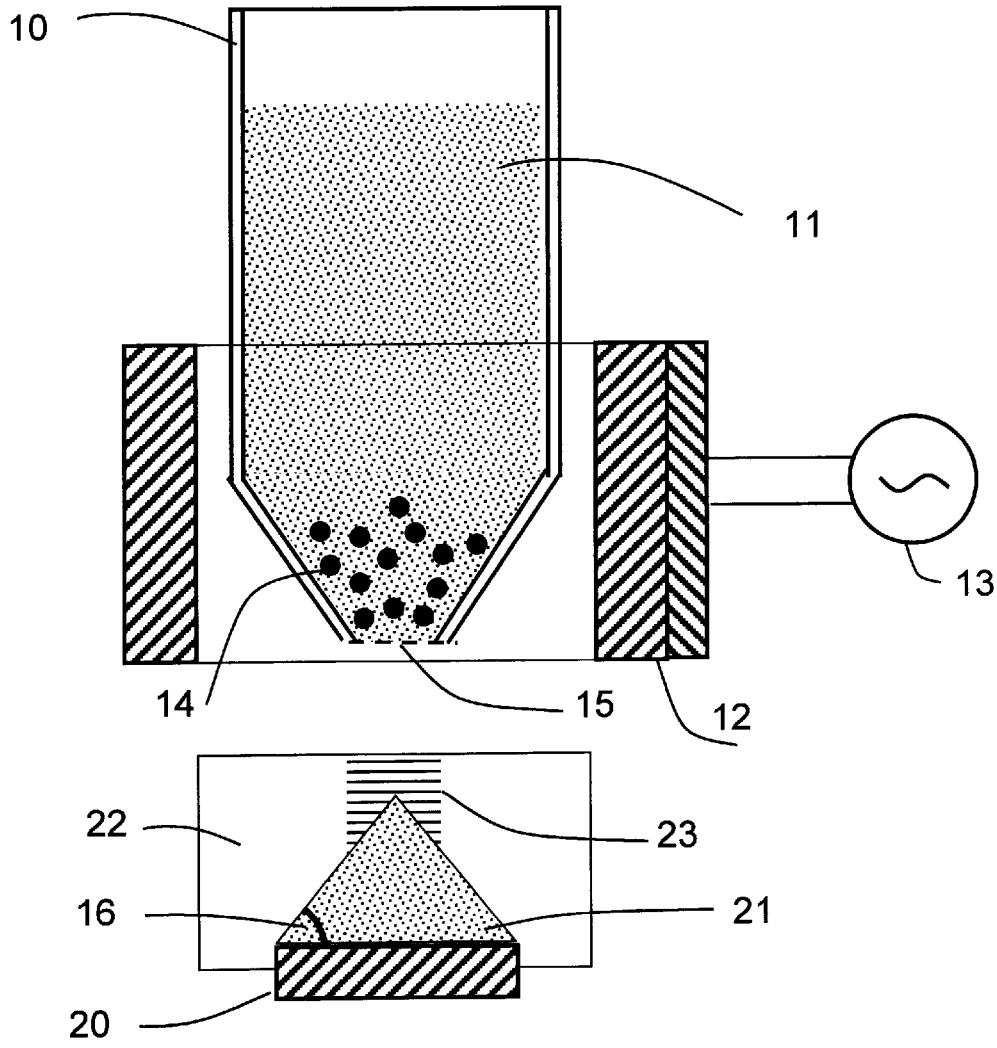
FIG. 3 is a cross-sectional view of another preferred embodiment of the present invention, to be used in measuring angle of repose.

FIG. 3 shows an alternate embodiment of a device useful in the present invention for measuring angle of repose of powder materials. In addition to the arrangement in FIG. 1, base 20 is placed upon which a pile 21 is formed of powder material 11 coming out from screen 15. Base 20 is of certain shape size, and surface property, but preferably circular cross-section, and the size dependent upon the quantity of powder 11 to be discharged. A mirror plate 22 marked with gratings 23 facilitates measurement of the height of powder heap 21 and hence the angle of repose 16 of powder material 11.

Figure 4:
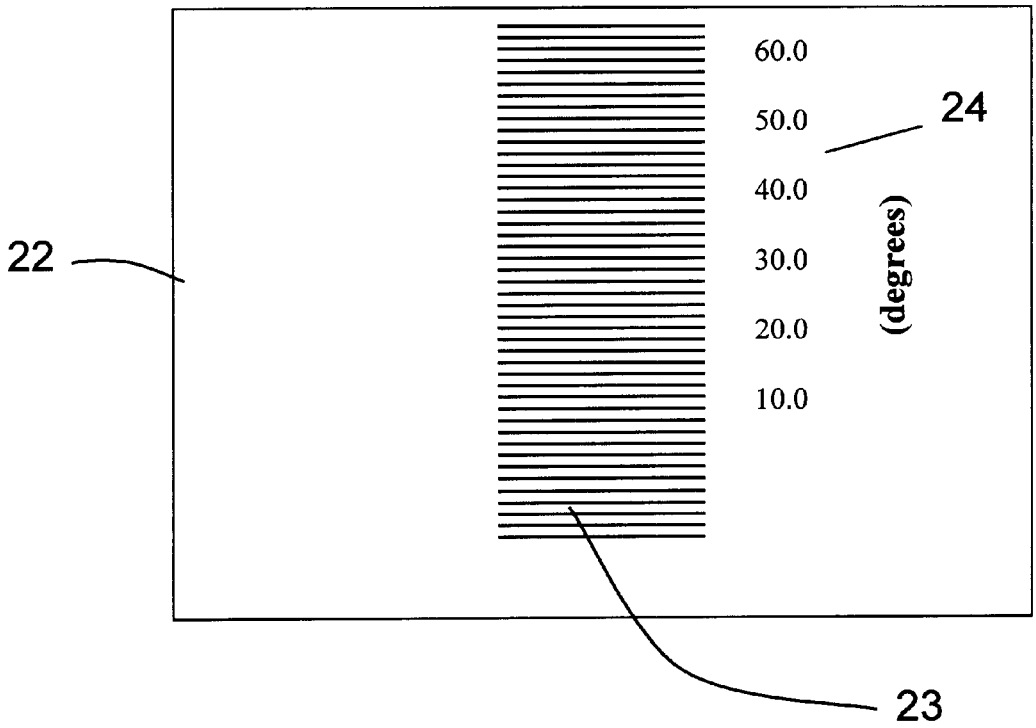
FIG. 4 is a detail view of the grating to facilitate measurement of angle of repose.

FIG. 4 shows a detailed view of plate 22 and gratings 23. Plate 22 can be made of glass or polished non-magnetic metal. Mirrored surface of plate 22 allows for alignment of operator's eye when measuring the height of pile 21 by reading a level of grating 23. Grating 23 can be in length units such as inches, centimeters or millimeters, or can be directly in terms of the degrees 24 of angle of repose 16 when matched with the size of base 20. Use of a mirror and a grating to facilitate the measurement of the angle of repose 16 is considered here for the sake of simplicity and is intended as an illustration only. The invention is not limited to the use of this device alone, and while not shown here, any other means to record the angle of the pile are within the scope and the spirit of the invention. Examples of other means include, use of a digital camera followed by a digital image analysis, or use of laser beam based angle metrology system.

Figure 5:
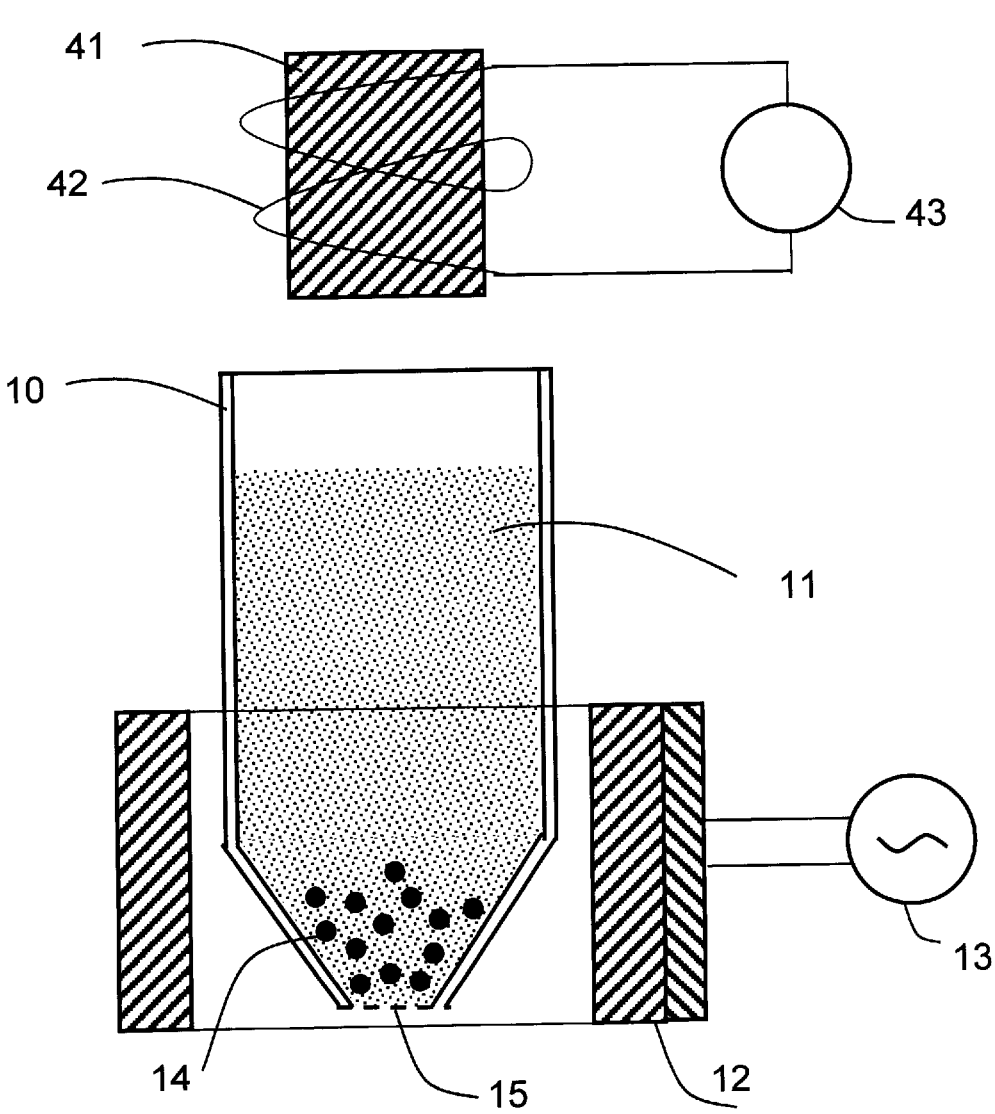
FIG. 5 is a cross-sectional view of another flow discharge system of the present invention that does not require screen at the outlet.

FIG. 5 illustrates an alternate embodiment for the present invention that shows an additional high intensity magnetic field generator such as a solenoid type magnetic element 41, magnetized by a solenoid coil 42, driven by a direct current power source 43. Magnetic element 41 provides an auxiliary unidirectional magnetic field that attracts magnetic particles 14 upwards, counteracting gravity and shear due to flow of powder material 11. Power source 43 may be constant, or more preferably, cyclically turned on and off, so as to turn auxiliary magnetic field on and off. When properly designed and operated, this would eliminate the need for screen 15.

Further details of various elements are described hereafter for all cases of embodiments of the present invention. Powder material 11 can also be granular material. It could be in the form of grains, spheres, flakes, and irregular shapes. Powder may be in the form of individual particles, loose agglomerates or even granules. The size may range from 0.005 $\mu$m to several millimeters or even larger. The size of magnets 14 need to be adjusted according to the size of the powder and may need to be about ten times or more of the size of the powder 11. The friability of the powder 11 may vary over a broad range and is limited only that the powder should be durable enough to permit its fluidization and flow induced by the collisions with the magnets and other powder particles, without causing excessive breakage of the primary particles. The density of the bulk powder material may also vary over a broad range, but it is preferred that its bulk density is less than the density of the magnetic particles. Powder and bulk material can be from varied industrial sectors such as agricultural, chemical, ceramic, electronics, mineral, pharmaceutical, and others, but not limited to just those.

Magnetic elements 14 can vary in material, shape and size. Typical materials used are hard barium ferrite ($BaO \bullet 6 Fe_2O_3$), AlNiCo ("alnico"), rare earth metals, ceramics or mixtures thereof. Such magnetic elements have coercivities ranging from 200 to 3000 oersteds. In order to minimize the attrition of the magnetic elements and the attrition by them on the container walls and screen, it is preferred to have a softer coating over the elements. For example, they can be coated with polymeric materials such as, cured epoxy or polytetrafluoethylene, to smooth the surface and make them more wear resistant. In addition, they can be comprised of magnetic powder embedded in a polymeric matrix, such as barium ferrite embedded in sulfur cured nitrile rubber such as ground pieces of PLASTIFORM™ Bonded Magnets, available from Arnold Engineering Co., Norfolk, Nebr. The size of the magnetic elements may vary from about ten times to about thousand times the size of the powder material, and may depend on the type of application and the powder material density and cohesive strength. The appropriate size of the magnetic elements can be readily determined by those skilled in the art. Shape of the magnetic elements can also vary, and could be spherical, elongated, irregular or other suitable shape.

The quantity of the magnetic elements required is dependent on the quantity of the powder that needs to be moved, its bulk density, cohesiveness, environmental factors such as moisture, temperature, time of consolidation. Preferably, only that quantity of magnetic elements needed to cause the powder near the container outlet zone to move and flow is used. In general, the weight of the magnetic elements should be approximately equal to the weight of the powder material near the outlet zone, for example, if a conical bottomed hopper is used, it should be approximately equal to the weight of the powder material in lower half of the conical section. However, the amount of magnetic material can be less or more depending upon the nature of application.

The magnetic field generator 12 may be supplied with power by means of oscillators, oscillator/amplifier combinations, solid-state pulsating devices and motor generators. The magnetic field may be generated by means of a solenoid coil, air core or laminated metal cores, stator devices or the like. The preferred magnetic field generator consists of one or more AC motor stators, i e., motors having armatures removed, which are powered by an alternating current supply through variable output transformers. In addition, metal strips may be placed outside the magnetic field generators to confine the magnetic field to a specific volume of space. The magnetic field oscillates by either changing the value in a sinusoidal fashion but keeping the direction the same, or changing the direction of the field itself, so that the field is rotating. The oscillating magnetic field can be caused, for example, by using multiphase stators to create a rotating magnetic field, as disclosed in Loveness, U.S. Pat. No. 3,848,363, or by using a single phase magnetic field generator with an AC power supply at a specified frequency to create a bipolar oscillating magnetic field. In highly cohesive powder materials, a rotating field is referred because the magnetic elements always encounter sufficient torque from the magnetic field, irrespective of their orientation, whereas in a bipolar field, they may get aligned with the field and may cease to move.

A useful magnetic field is one with an intensity sufficient to cause desirable motion and excitation of magnetic elements 14, but not large enough to demagnetize the magnetic character of magnetic elements that are moved by the oscillating magnetic fields. Magnetic field intensity may range between about 1 oersted and 3000 oersteds, preferably between about 200 and 2500 oersteds.

Another important characteristic of magnetic field is defined by the frequency of oscillations. The frequency of oscillations in the oscillating magnetic field affects the movement and subsequently the number of collisions that take place between a magnetic element that is moved in the magnetic field and surrounding powder and particles that are caused to move and are fluidized. If the oscillating frequency is too low, the magnetic elements move too slowly and do not have sufficient motion to cause the other powder material to flow. If the oscillating frequency is too high, the magnetic elements are not able to spin in the fast changing field due to their inertia. The frequency may be from 5 hertz to 100,000 hertz, preferably from about 50 hertz to 1000 hertz, and even more conveniently at the hertz which is commonly used in AC power supplies, i.e., 50 hertz, 60 hertz, and 400 hertz.

Screens 15 can be made of various materials including polymeric materials, ceramic materials and metal. Preferably the screens are made from stainless steel or nylon. Although eddy currents may form if the screens are made from metal, in most applications, they do not seem to be strong enough to have a significant effect on the applied field. The mesh size should be as large as possible, without being so large that it would allow the magnetic elements to pass through and be lost from the container. The screen should be sufficiently strong to withstand the load of the materials above, and the shear of flow of powders and collisions by the magnetic elements. Although not shown in the Figures, if necessary, the screen may be supported by an additional non-metallic support structure to provide sufficient strength.

The bulk material storage container can be of variety of shapes and sizes, and is not intended to be restricted just to conical-cylindrical hoppers. If possible, the container should be made of non-metallic material so that the problems associated with eddy current generation in metallic parts and subsequent loss in magnetic field are eliminated. Alternately, the bottom portion of the container from where the powder must come out and where the magnetic elements predominate should be made of non-metallic material. In case a metal must be used, it should preferably be non-ferrous and should not have magnetic properties similar to iron. Although not shown explicitly in the figures disclosed in this invention, the powder container does not always have to have the powder outlet at the bottom. The powder outlet can be at any other location, but if it is not at the bottom, the magnetic particles must excite the powder sufficiently to force the powder out through the screen even against the gravity force. In such cases, it is desired that the container be made of non-metallic materials.

When a screen at the outlet is not desirable, an auxiliary field generator is utilized. It is intended to provide a sufficiently large magnetic attraction on magnetic elements 14 so as to counteract the gravity and flow shear forces, and hence to keep them within the container. However, the auxiliary field should not be so large that it pulls the magnetic elements completely away from the powder. Alternately, the field can be turned on and off so that the magnetic elements are kept within the region where the powder is excited to flow out. However, it is likely that a few magnetic particles will still escape from the outlet, hence other means (not shown here) such as placement of magnets below the outlet may be required to pull the magnets away to from the falling powder.

Advantages and operation of the present invention are further illustrated by the following examples, but the particular materials and amounts thereof recited in these examples; as well as other conditions and details, should not be construed to unduly limit this invention. In these examples, the magnetic elements were obtained from Aveka, Inc., Woodbury, Minn., where they were prepared by grinding PLASTIFORM™ magnetic material, available from The Arnold Engineering Co., Norfolk, Nebr. In some cases, the ground material was coated by polymeric material such as Teflon followed by size screening to obtain desired nominal size.

EXAMPLES 1–8

In Example 1, the magnetic particles, barium ferrite ($BaO \bullet 6\ Fe_2O_3$), coated with Teflon, obtained from Aveka, Inc., Woodbury, Minn., of size range 0.85–3 mm were used. Powder material was cornstarch, (Argo brand) of mean diameter 15 $\mu$m. The powder container was cylindrical-conical combination Plexiglas hopper, with the conical bottom part with a 60° inclination. The inclination angle was measured with respect to horizontal axis. The hopper diameter and height were 5 cm and 15 cm respectively. The hopper outlet was 2.5 cm. The outlet of the hopper was covered by a fine mesh (No. 40, North Wire Clothes—635 μm opening) to keep the magnetic particles in the system while the fine powder could be discharged through the mesh. This hopper was placed within the core of an electric motor stator, removed from a 115 V, 50 Hz, Baldor motor (Cat. P/N 150-090-13) that was connected to a variable power transformer which was connected to an alternating current power supply at 110 V, 50 Hz. The variable power transformer allowed input voltage to the stator ranging from 0 to 110 volts. Approximately 1 g of magnets was placed in the hopper, followed by deposition of 40 g of cornstarch. Due to the screen at the outlet, the cornstarch remained inside the hopper. However, when a 20 V power was turned on, the cornstarch smoothly flowed out of the hopper. The outflowing cornstarch was collected on an electronic scale, and when the collected mass was plotted with respect to time, an excellent linear trend was observed, indicating a uniform mass flow rate achieved by this device. The results were repeatable for a series of similar experiments.

In Example 2, all the conditions were similar to Example 1, except that the amount of magnets was varied from 0.25 g to 3.00 g in a series of experiments. For each case of magnet mass value, the mass flow rate of cornstarch was measured. When the mass flow rate values were plotted against the mass of the magnets, a monotonic, linear trend was observed, indicating that as the magnet mass was increased, the flow rate also increased.

In Example 3, all the conditions were the same as in Example 1, except that power supplied to the field generator coil w as varied by changing the input voltage from a value of 10 V to 25 V. For each case of input voltage, the mass flow rate of cornstarch was measured. When the mass flow rate values were plotted against the input voltage a monotonic trend was observed, indicating that as the voltage was increased, the flow rate also increased. However, when the voltage was increased beyond that value, the mass flow rate began to decrease, indicating an excessive magnetic particle activity that caused more fluidization of cornstarch and hence restricted the flow.

In Example 4, all the conditions were the same as in Example 1, except that the size of the magnetic particles was varied from a nominal of 0.85 mm to 2.36 mm. While the size of the magnetic particles was varied, the total mass was kept fixed, so that for a smaller magnet particle size, the number of magnets was much larger than for the larger magnet particle size. For each case of the size of the magnets, the mass flow rate of cornstarch was measured. When the mass flow rate values were plotted against the size of the magnets, the trend was an initial increase in the flow rate, and then after reaching a peak, it showed a decrease. This indicated that there was an optimal magnet size for this experimental situation.

In Example 5, all the conditions were the same as in Example 1, except that a straight cylindrical, flat-bottomed bin was used with the outlet size of 5 cm. Results showed a similar trend as in Example 1, except that the flow rate was higher due to a larger outlet size.

In Example 6, the conditions were the same as Example 2, but once again, a straight cylindrical, flat-bottomed bin was used with outlet size of 5 cm. The results showed a monotonic, but non-linear trend between the mass flow rate and the mass of the magnets.

In Example 7, the conditions were the same as Example 3, but once again, a straight cylindrical, flat-bottomed bin was used with the outlet size of 5 cm. The results showed that the mass flow rate increased initially as the voltage increased, but beyond about 20 V, it started to decrease.

In Example 8, the conditions were the same as Example 4, but once again, a straight cylindrical, flat-bottomed bin was used with the outlet size of 5 cm. The results showed a similar trend between the mass flow rate and the mass of the magnets.

Examples 1 through 8 were repeated after the cornstarch was consolidated to a bulk density of 0.79 g/cm$^3$. For consolidated cornstarch the results of flow were similar but some of the trends changed. Overall, more magnets and in some cases higher input voltage were required.

EXAMPLES 9–14

Examples 9 through 14 were all similar to Example 1, except in each case, the powder material was different and the mass of magnets was adjusted to achieve a desired flow. In Example 9, the material used was commercial grade calcium carbonate. Smooth flow was achieved with about 2 g of magnets. In Example 10, lactose was used, and even flow was achieved using about 1.5 g of magnets. Example 11 utilized pharmaceutical grade Avicel, and Example 12 utilized food quality cellulose, and in both cases, even flow was achieved with about 1 to 2 g of magnets. In Example 12 and 13, fumed silica and sub-micron titania were used. In both the cases, even flow was achieved with about 1 to 1.5 g of magnets. In Example 14, non-granulated carbon black of nominal size of sub-microns was used. Excellent flow was observed when about 2 g of magnets was used and the input voltage was about 30 V.

EXAMPLES 15–21

Examples 15 through 21 utilize the preferred embodiment depicted in FIG. 3, except that a digital camera and a PC based digital image analysis system was utilized to measure the angle of repose from a digital image of the pile formed. Examples 15 through 21 utilized different powder materials, all of which are cohesive in nature and have high repose angles. In all these examples, several parameters were varied, such as the amount of sample, applied voltage, amount of magnetic particles, height from which the powder was allowed to fall to form a pile, hopper outlet size, and mesh size. All these parameters seem to affect the value obtained for the angle of repose, but in each case, a range of values could be selected that gave consistent results. Example 15 utilized cornstarch, Example 16 utilized commercial grade calcium carbonate, Example 17 utilized pharmaceutical grade Avicel, Example 18 utilized food grade cellulose, Example 19 utilized fumed silica, Example 20 utilized sub-micron sized titania, and Example 21 utilized non-granulated carbon black.

The principles, preferred embodiments, and modes of operation of the present invention have been described herein. The invention is not to be construed as limited to the particular forms disclosed, since these are to be regarded as illustrative rather than restrictive. Variations to and changes may be made by those skilled in the art without departing from the spirit of the invention.

What is claimed is:

1. A process of promoting controlled flow of solid material, the process comprising the steps of:

(a) providing a container having an opening and an outlet for holding the solid material;

(b) providing a plurality of magnetic particles within the solid material near the outlet; the magnetic particles having coercivities ranging from about 200 to about 3000 oersteds;

(c) providing a screen at the outlet to allow the solid material to be dispensed while keeping the magnetic particles within the container; and (d) exciting the magnetic particles with sufficient oscillating electromagnetic energy to create motion of the magnetic particles and cause sufficient disturbance to break up the solid material and enable the solid material to be dispensed from the outlet, the motion of the magnetic particles being characterized by spinning of the magnetic particles; and (e) allowing the dispensed solid material to fall onto a base, to form a heap or pile so that its angle of repose can be measured, the base comprising a reflecting plate with a grating calibrated in units of length to facilitate measurement of the angle of repose.

2. The process according to claim 1, wherein the units are degrees directly indicating the value of the angle of repose.

3. An apparatus for promoting controlled flow of solid material, the apparatus comprising:

(a) a storage container having an opening and an outlet for holding the solid material;

(b) a plurality of magnetic particles within the solid material near the outlet, the magnetic particles having coercivities ranging from about 200 to about 3000 oersteds;

(c) a screen at the outlet to allow the solid material to be dispensed while keeping the magnetic particles within the container; and (d) an oscillating electromagnetic energy supplier to create motion of the magnetic particles and cause sufficient disturbance to break up the solid material and enable the solid material to be dispensed from the outlet, and to fall onto a base to form a heap or pile so that its angle of repose can be measured, the base further comprising a reflecting plate with a grating calibrated in units of length to facilitate measurement of the angle of repose.

4. The apparatus according to claim 3, wherein the units are degrees directly indicating the value of the angle of repose.

5. The apparatus according to claim 4, wherein the powder flow is controllable by adjusting the electromagnetic energy supplier.

* * * * *